US009719284B2

(12) United States Patent
Chen et al.

(10) Patent No.: US 9,719,284 B2
(45) Date of Patent: Aug. 1, 2017

(54) HINGE AND DAMPING DEVICE THEREOF

(71) Applicants: KING SLIDE WORKS CO., LTD., Kaohsiung (TW); KING SLIDE TECHNOLOGY CO.,LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 15/202,583

(22) Filed: Jul. 6, 2016

(65) Prior Publication Data

US 2017/0152693 A1 Jun. 1, 2017

(30) Foreign Application Priority Data

Nov. 26, 2015 (TW) ..... 104139603 A

(51) Int. Cl.
*E05F 1/08* (2006.01)
*E05F 1/12* (2006.01)
(Continued)

(52) U.S. Cl.
CPC ..... *E05F 5/02* (2013.01); *E05F 5/006* (2013.01); *E05F 5/027* (2013.01)

(58) Field of Classification Search
CPC ..... E05Y 2900/20; E05Y 2900/202; E05Y 2900/204; E05Y 2900/208; E05Y 2201/20; E05Y 2201/21; E05Y 2201/256; E05Y 2201/264; E05Y 2201/266; E05Y 2201/638; E05F 5/006; E05F 5/02; E05F 5/10; E05F 5/027; E05D 11/1021; E05D 11/1042; E05D 11/105; E05D 11/1064;
(Continued)

(56) References Cited

U.S. PATENT DOCUMENTS 7,065,833 B2 6/2006 Kropf
7,552,509 B2 * 6/2009 Chen ..... E05F 5/10 16/286

(Continued)

FOREIGN PATENT DOCUMENTS

AT 509 720 A4 11/2011
DE 10 2011 050 053 A1 11/2012
EP 2 746 509 A1 6/2014

*Primary Examiner* — Chuck Mah
(74) *Attorney, Agent, or Firm* — Winston Hsu

(57) ABSTRACT

A damping device is applicable to a hinge. The damping device includes a housing, a damper, an abutting member and an adjusting member. The damper is arranged on the housing. The damper includes a first movable member and a second movable member movable relative to each other. The abutting member is configured to abut against the second movable member of the damper. The adjusting member is movable relative to the housing. When the adjusting member is moved to a first position relative to the housing, the adjusting member abuts against the first movable member of the damper. When the adjusting member is moved to a second position relative to the housing, the adjusting member does not abut against the first movable member of the damper.

7 Claims, 10 Drawing Sheets

(51) Int. Cl.
*E05D 3/02* (2006.01)
*E05F 5/02* (2006.01)
*E05F 5/00* (2017.01)

(58) Field of Classification Search
CPC ..... E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 8,561,262 | B1 * | 10/2013 | Liang | E05F 5/006 16/286 |
| 8,601,644 | B1 | 12/2013 | Chen | |
| 8,650,711 | B1 * | 2/2014 | Chen | E05F 5/006 16/286 |
| 8,857,014 | B2 | 10/2014 | Brunnmayr | |
| 8,991,010 | B2 | 3/2015 | Brunnmayr | |
| 9,057,214 | B2 * | 6/2015 | Salice | E05F 5/006 |
| 9,163,447 | B1 * | 10/2015 | Liang | E05F 5/006 |
| 2012/0180262 | A1 * | 7/2012 | Zimmer | E05F 5/006 16/319 |
| 2013/0145580 | A1 * | 6/2013 | Brunnmayr | E05F 5/006 16/277 |
| 2013/0160242 | A1 * | 6/2013 | Brunnmayr | E05F 5/006 16/286 |
| 2014/0345081 | A1 * | 11/2014 | Salice | E05F 5/006 16/50 |
| 2014/0352111 | A1 * | 12/2014 | Ng | E05F 5/02 16/286 |

* cited by examiner

HINGE AND DAMPING DEVICE THEREOF

BACKGROUND OF THE INVENTION

1. Field of the Invention

The present invention relates to a damping device, and more particularly, to a damping device applicable to a hinge.

2. Description of the Prior Art

As related technology keeps improving, a hinge with a damping device becomes a common technique. U.S. Pat. No. 8,561,262 B1 discloses a damping device applicable to a hinge, wherein the damping device comprises an adjustment member (20) having a protruded portion (92). The adjustment member (20) can be adjusted to move, in order to decide whether the protruded portion (92) faces toward a piston rod (76) of a damper (18). In other words, through adjusting the adjustment member (20), the damper (18) can be set whether to provide damping effect on a target object or not. However, for different market requirements, dampers with different adjusting methods can be provided to bring more options to the market.

SUMMARY OF THE INVENTION

The present invention relates to a damping device having an adjusting member.

According to an embodiment of the present invention, a damping device comprises a housing, a damper, an abutting member and an adjusting member. The damper is arranged on the housing. The damper comprises a first movable member and a second movable member longitudinally movable relative to each other. The abutting member is configured to abut against the second movable member of the damper. The adjusting member is movable relative to the housing. Wherein, when the adjusting member is moved to a first position relative to the housing, the adjusting member abuts against the first movable member of the damper. Wherein, when the adjusting member is moved to a second position relative to the housing, the adjusting member does not abut against the first movable member of the damper.

According to the above embodiment, the housing has a longitudinal passage configured to accommodate the damper.

Preferably, the housing comprises an extension part adjacent to the longitudinal passage, and the adjusting member is movably installed on the extension part Preferably, the adjusting member comprises a main body and a flexible part connected to the main body. One of the main body of the adjusting member and the extension part of the housing has a transverse guiding feature for allowing the adjusting member to be transversely movable relative to the housing.

According to the above embodiment, the first movable member of the damper is a cylinder and the second movable member of the damper is a piston rod.

According to another embodiment of the present invention, a hinge comprises a first component, a second component, an elastic member, a linkage member and a damping device. The second component is pivoted to the first component. The elastic member is configured to provide an elastic force when the second component is opened or closed relative to the first component. The linkage member is configured to move when the second component is rotated relative to the first component. The damping device is installed on one of the first component and the second component. The damping device comprises a housing, a damper, an abutting member and an adjusting member. The damper is arranged on the housing. The damper comprises a first movable member and a second movable member longitudinally movable relative to each other. The abutting member is configured to abut against the second movable member of the damper for allowing the first movable member to be moved between a first predetermined position and a second predetermined position relative to the second movable member. The adjusting member is movable relative to the housing. Wherein, when the adjusting member is moved to a first position relative to the housing, the adjusting member abuts against the first movable member of the damper, such that the first movable member is located at the first predetermined position. Wherein, when the adjusting member is moved to a second position relative to the housing, the adjusting member does not abut against the first movable member of the damper, such that the first movable member is located at the second predetermined position, and when the second component is moved to switch from an open state to a close state relative to the first component, the linkage member pushes the first movable member of the damper from the second predetermined position to the first predetermined position for providing damping effect.

According to the above embodiment of the present invention, the housing has a longitudinal passage configured to accommodate the damper, and an extension part adjacent to the longitudinal passage. The adjusting member is movably installed on the extension part.

Preferably, the adjusting member comprises a main body and a flexible part connected to the main body. One of the main body of the adjusting member and the extension part of the housing has a transverse guiding feature for allowing the adjusting member to be transversely movable relative to the housing.

Preferably, the main body of the adjusting member has the transverse guiding feature. The transverse guiding feature comprises a first hole, a second hole, and at least one guiding section location between the first hole and the second hole. The hinge further comprises a mounting member connected to the extension part of the housing and passing through one of the first hole and the second hole.

According to another embodiment of the present invention, a hinge comprises a first component, a second component, an elastic member, a linkage member, and a damping device. The second component is pivoted to the first component. The elastic member is configured to provide an elastic force when the second component is opened or closed relative to the first component. The linkage member is configured to move when the second component is rotated relative to the first component. The damping device is installed on one of the first component and the second component. The damping device comprises a housing, a damper, an abutting member and an adjusting member. The damper is arranged on the housing. The damper comprises a first movable member and a second movable member longitudinally movable relative to each other. The first movable member comprises an abutting part. The abutting member is configured to abut against the second movable member of the damper for allowing the first movable member to be moved between a first predetermined position and a second predetermined position relative to the second movable member. The adjusting member is movable between a first position and a second position relative to the housing. The adjusting member comprises a main body and a flexible part connected to the main body. Wherein, when the first movable member of the damper is located at the second predetermined position relative to the second movable member and the adjusting member is located at the first position relative to the housing, the flexible part of the adjusting member abuts against the first movable member of the damper. Wherein, when the second component is moved to switch from an open state to a close state relative to the first component, the linkage member pushes the first movable member of the damper from the second predetermined position to the first predetermined position for allowing the flexible part of the adjusting member to abut against the abutting part, in order to hold the first movable member at the first predetermined position relative to the second movable member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
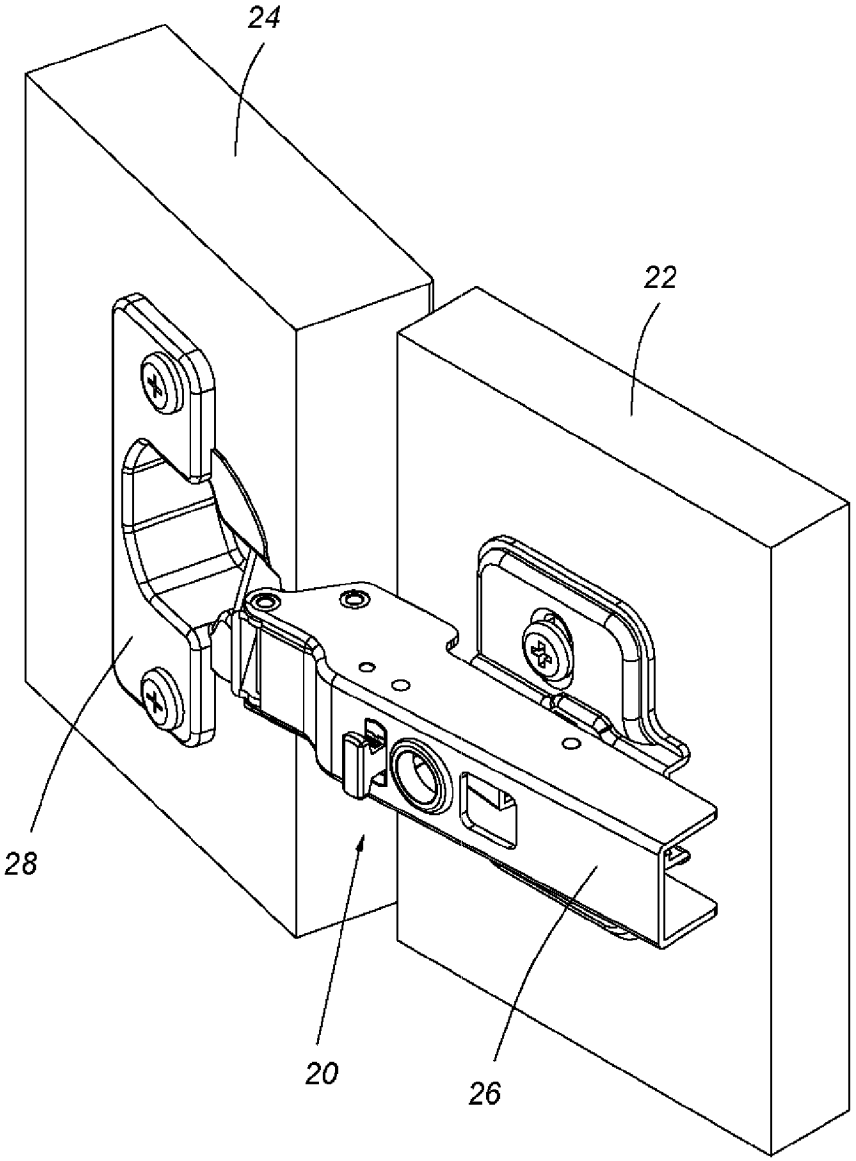
FIG. 1 is a diagram showing a hinge applied to two movable objects according to an embodiment of the present invention.

FIG. 1 is a diagram showing a hinge 20 applied to two movable objects according to an embodiment of the present invention. In the present embodiment, the two movable objects can be a first furniture part 22 and a second furniture part 24 for example. The hinge 20 comprises a first component 26 installed on the first furniture part 22, and a second component 28 installed on the second furniture part 24. The first component 26 can be a hinge arm. The second component 28 can be a hinge cup. Wherein, the second component 28 is pivoted to the first component 26 (for example, through hinge connection), such that the second furniture part 24 can be opened or closed relative to the first furniture part 22.

Figure 2:
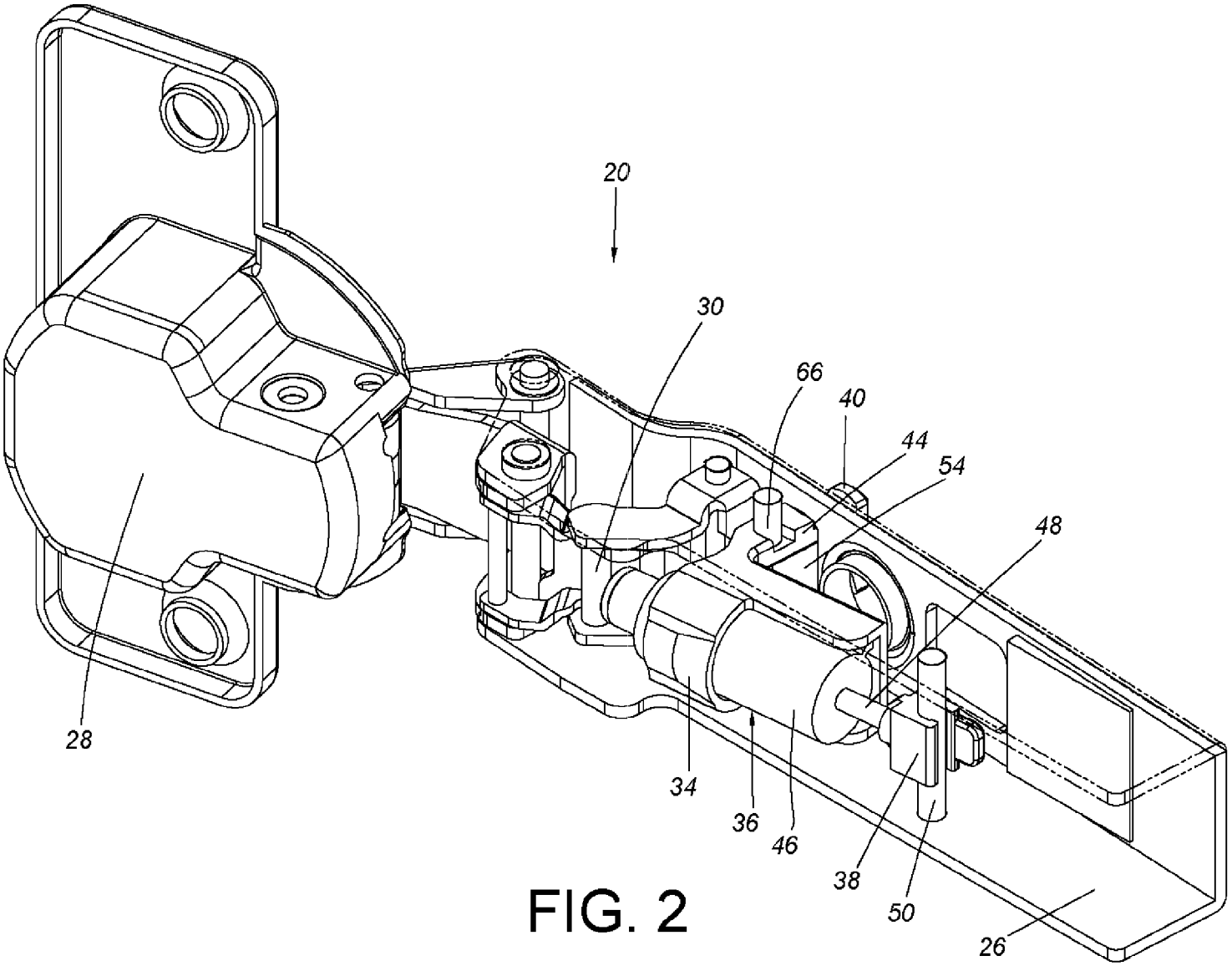
FIG. 2 is a diagram showing a hinge according to an embodiment of the present invention.
Figure 3:
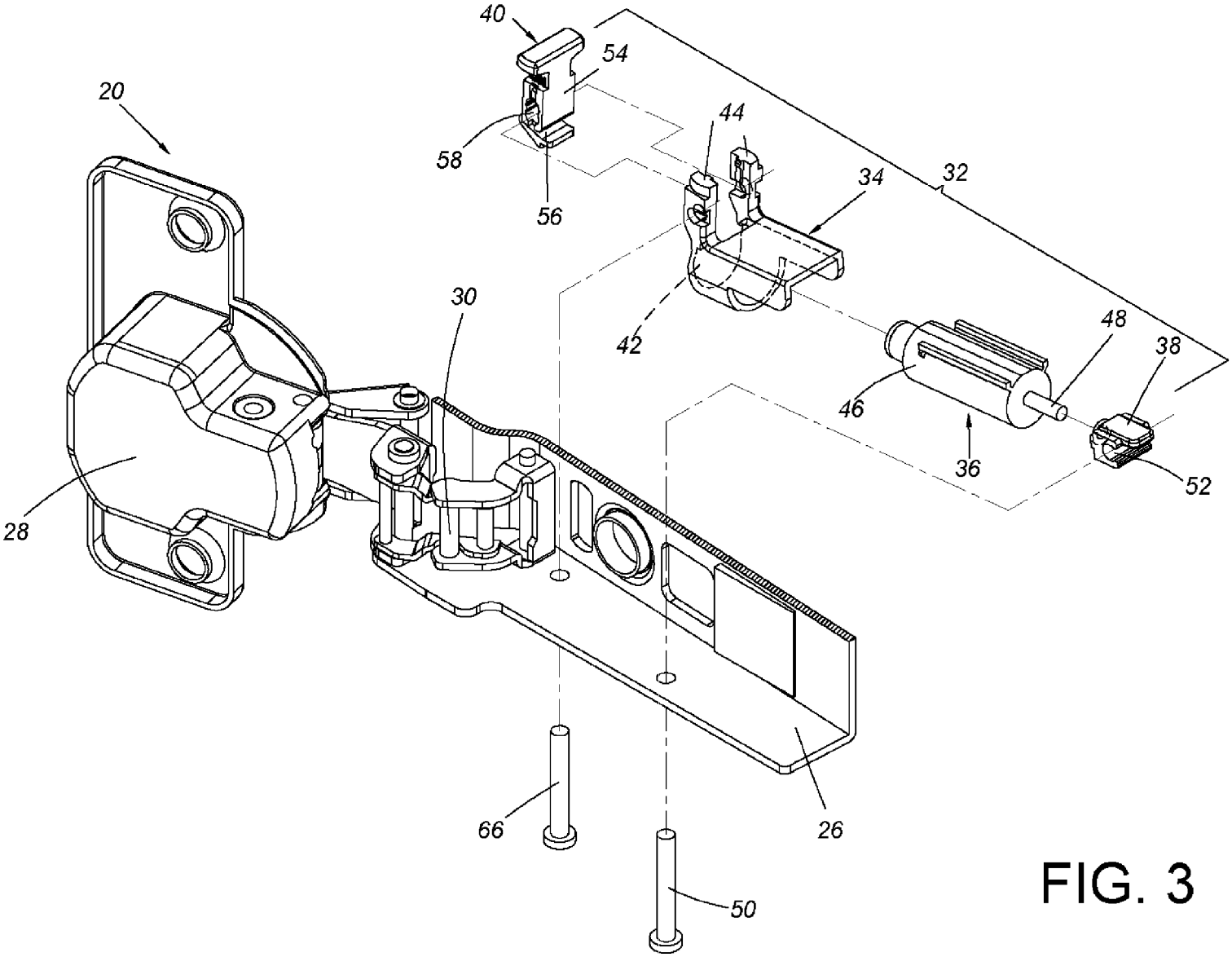
FIG. 3 is an exploded view of the hinge with a damping device according to an embodiment of the present invention.

As shown in FIG. 2 and FIG. 3, the hinge 20 comprises a linkage member 30 and a damping device 32. The linkage member 30 can be moved in response to a movement of the second component 28 relative to the first component 26. The damping device 32 can be installed on one of the first component 26 and the second component 28. In the present embodiment, the damping device 32 is installed on the first component 26 for example. The damping device 32 comprises a housing 34, a damper 36, an abutting member 38 and an adjusting member 40. The housing 34 has a longitudinal passage 42 and at least one extension part 44 adjacent to the longitudinal passage 42. In the present embodiment, the housing has a pair of extension parts 44 for example. The damper 36 is arranged on the housing 34, such as being accommodated in the longitudinal passage 42 of the housing 34. The damper 36 comprises a first movable member 46 and a second movable member 48 longitudinally movable relative to each other. In the present embodiment, the first movable member 46 can be a cylinder, and the second movable member 48 can be a piston rod being constantly driven by a force to extend out of the cylinder. Operation of the cylinder and the piston rod is well known to those skilled in the art, therefore, no further illustration is provided. The abutting member 38 is configured to abut against the second movable member 48 of the damper 36. Preferably, the first component 26 of the hinge 20 is arranged with a first mounting member 50, such as a supporting shaft. The abutting member 38 has a buckling part 52, such as a pair of buckling hooks configured to engage with the first mounting member 50.

Figure 4:
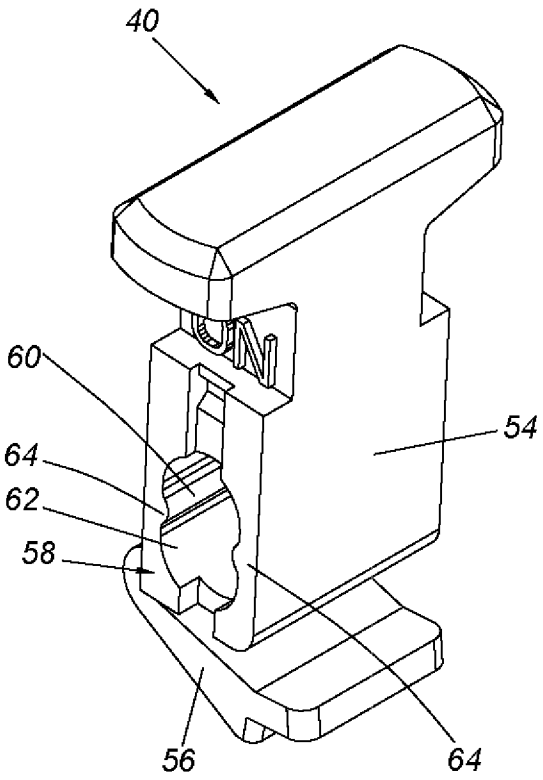
FIG. 4 is a diagram showing an adjusting member of the damping device according to an embodiment of the present invention.

As shown in FIG. 3 and FIG. 4, the adjusting member 40 is movably installed on the extension part 44 of the housing 34. In particular, the adjusting member 40 comprises a main body 54 and a flexible part 56 connected to the main body 54. One of the main body 54 of the adjusting member 40 and the extension part 44 of the housing 34 has a transverse guiding feature 58. In the present embodiment, the main body 54 of the adjusting member 40 has the transverse guiding feature 58 for example. The transverse guiding feature 58 comprises a first hole 60, a second hole 62, and at least one guiding section 64 located between the first hole 60 and the second hole 62. Preferably, the first component 26 of the hinge 20 is further arranged with a second mounting member 66, such as a supporting shaft connected to the extension part 44 of the housing 34 and passing through one of the first hole 60 and the second hole 62 of the transverse guiding feature 58 of the adjusting member 40.

Figure 5:
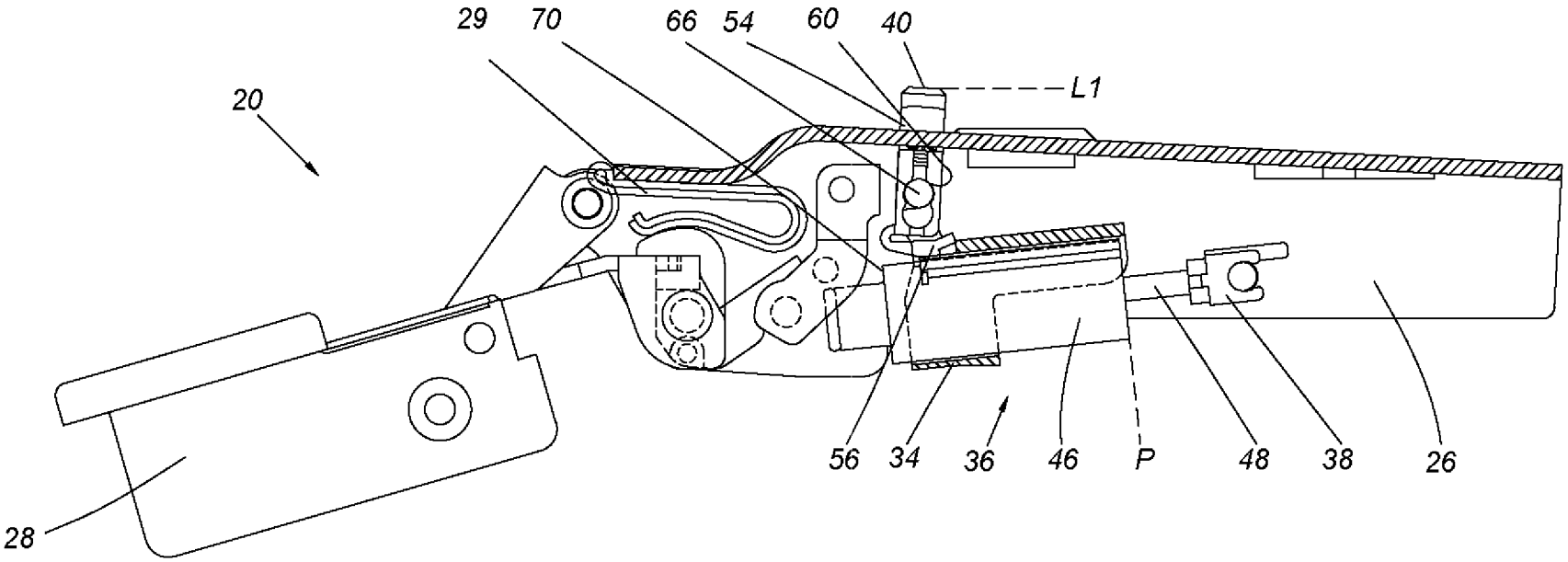
FIG. 5 is a diagram showing the hinge according to an embodiment of the present invention, wherein a second component is opened relative to a first component.

As shown in FIG. 5, the second component 28 of the hinge 20 is in an open state relative to the first component 26. Wherein, the hinge 20 further comprises an elastic member 29 configured to provide an elastic force when the second component 28 is opened or closed relative to the first component 26. The first hole 60 of the adjusting member 40 is configured to partially cover the second mounting member 66. The first movable member 46 of the damper 36 has an abutting part 70. The second movable member 48 of the damper 36 abuts against the abutting member 38, and the first movable member 46 is located at an extension position P relative to the second movable member 48. Accordingly, a user can adjust the adjusting member 40 to be at a first position L1 relative to the housing 34 or the damper 36. In such state, the flexible part 56 of the adjusting member 40 abuts against a lateral side of the first movable member 46 of the damper 36, such that the flexible part 56 is pressed to accumulate an elastic force.

Figure 6:
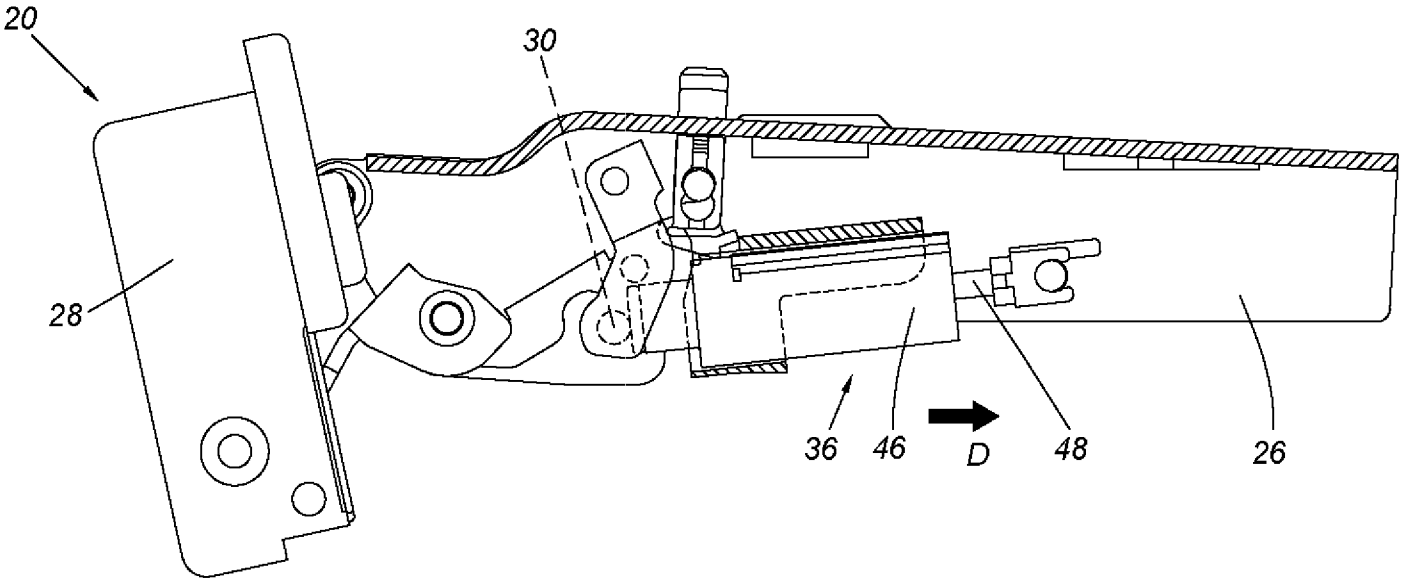
FIG. 6 is a diagram showing a process of the second component of the hinge in FIG. 5 being moved to switch from an open state to a close state relative to the first component.

As shown in FIG. 5 and FIG. 6, when the second component 28 of the hinge 20 is moved to switch from the open state to a close state relative to the first component 26, the linkage member 30 is moved due to rotation of the second component 28 relative to the first component 26, and the linkage member 30 further pushes the first movable member 46 of the damper 36 to move along a direction D from the extension position P relative to the second movable member 48.

Figure 7:
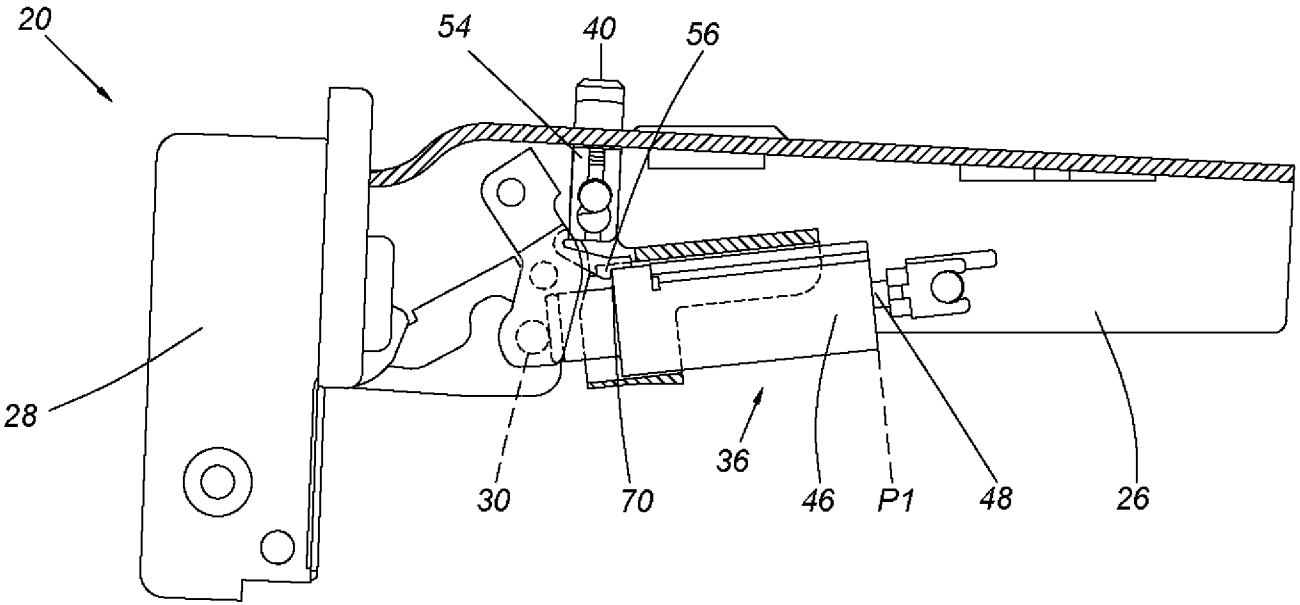
FIG. 7 is a diagram showing the second component of the hinge in FIG. 6 being closed relative to the first component.

As shown in FIG. 6 and FIG. 7, when the second component 28 of the hinge 20 is moved to be in the close state relative to the first component 26, the linkage member 30 pushes the first movable member 46 of the damper 36 to move to a first predetermined position P1 relative to the second movable member 48. When the first movable member 46 of the damper 36 is located at the first predetermined position P1, the flexible part 56 of the adjusting member 40 no longer abuts against the lateral side of the first movable member 46 of the damper 36 and releases the elastic force to further abut against the abutting part 70 of the first movable member 46 of the damper 36, in order to hold the first movable member 46 at the first predetermined position P1.

Figure 8:
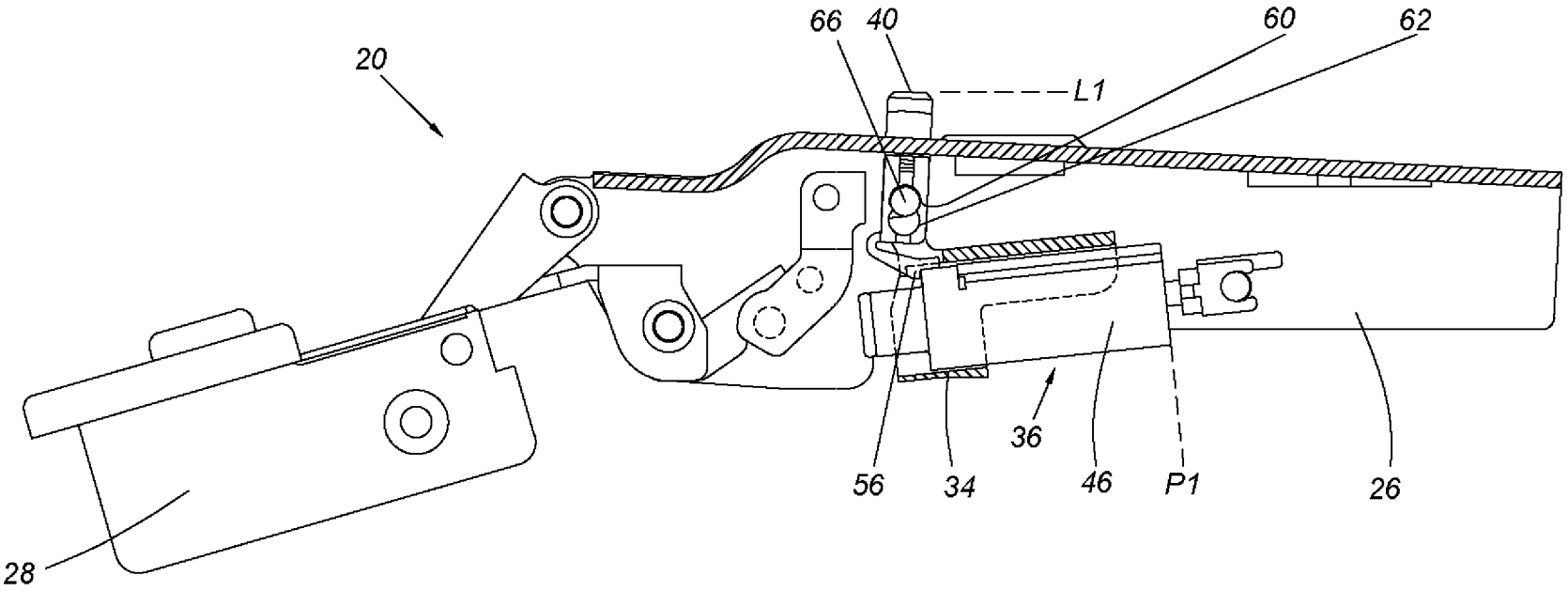
FIG. 8 is a diagram showing the second component of the hinge being opened relative to the first component and an adjusting member located at a first position with abutting against a first movable member of a damper according to an embodiment of the present invention.

As shown in FIG. 8, when the first movable member 46 of the damper 36 is held at the first predetermined position P1 by the flexible part 56 of the adjusting member 40, the second component 28 of the hinge 20 can be operatively opened relative to the first component 26 again.

Figure 9:
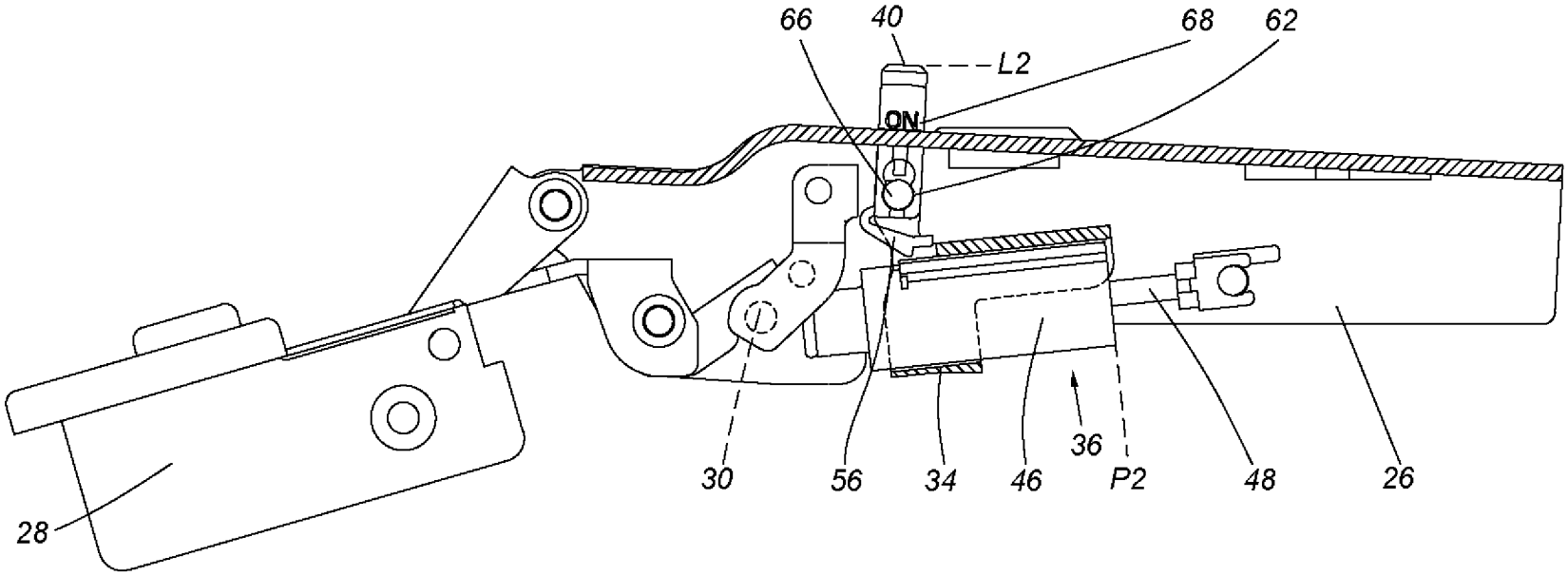
FIG. 9 is a diagram showing the second component of the hinge being opened relative to the first component and the adjusting member located at a second position without abutting against the first movable member of the damper according to an embodiment of the present invention.

As shown in FIG. 8 and FIG. 9, when the second component 28 is opened relative to the first component 26, the user can adjust the adjusting member 40 to move from the first position L1 to a second position L2 relative to the housing 24 or the damper 36, such that the second mounting member 66, which is originally accommodated in the first hole 60, is then accommodated in the second hole 62 of the adjusting member 40. Since the adjusting member 40 is location at the second position L2, the flexible part 56 of the adjusting member 40 does not abut against the first movable member 46 of the damper 36, such that the first movable member 46 can be driven by a damping medium and/or an elastic member therein to move from the first predetermined position P1 to a second predetermined position P2 relative to the second movable member 48 in order to be in a damping ready state. Preferably, the adjusting member 40 has an indicating feature, such as a word "ON", for indicating that a damping function is provided in such state. The damping medium and/or the elastic member is well known to those skilled in the art, therefore, no further illustration is provided.

Figure 10:
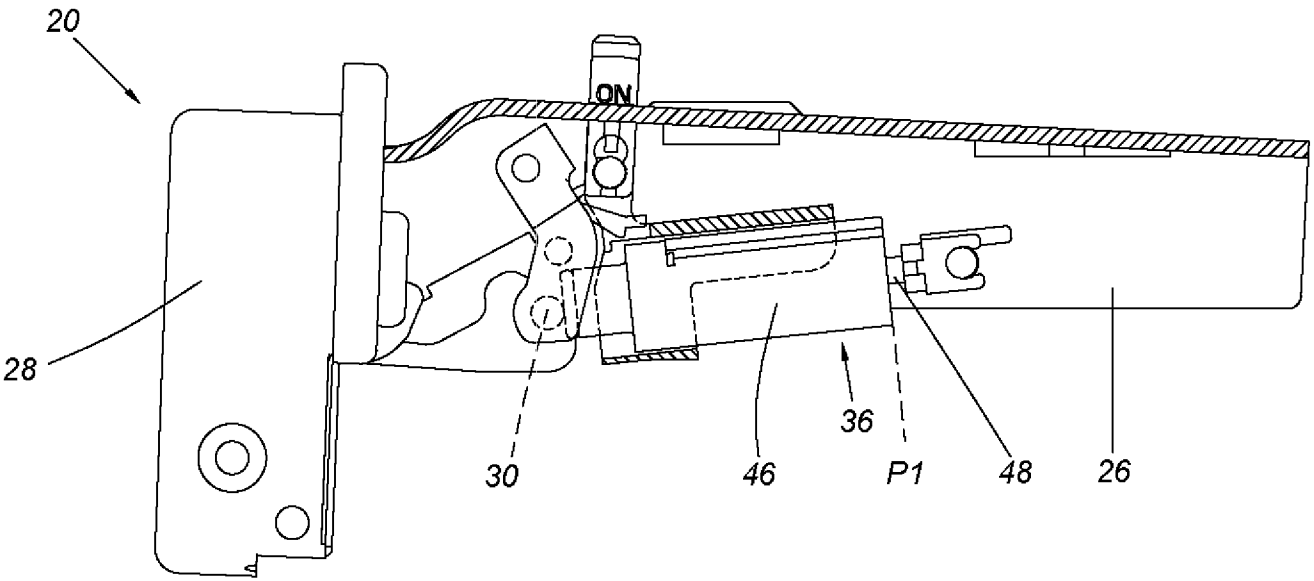
FIG. 10 is a diagram showing the second component of the hinge in FIG. 9 being closed relative to the first component.

As shown in FIG. 9 and FIG. 10, when the second component 28 of the hinge 20 is moved to switch from the open state to the close state relative to the first component 26, the linkage member 30 is moved due to the rotation of the second component 28 relative to the first component 26, and the linkage member 30 further pushes the first movable member 46 of the damper 36 to move from the second predetermined position P2 to the first predetermined position P1 relative to the second movable member 48 for providing damping effect.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A damping device comprising:

a housing;

a damper arranged on the housing, the damper comprising a first movable member and a second movable member longitudinally movable relative to each other;

an abutting member configured to abut against the second movable member of the damper; and an adjusting member transversely movable relative to the housing, wherein the adjusting member has a first hole, a second hole, and at least one guiding section located between the first hole and the second hole, the adjusting member is connected to the housing by a mounting member passing through one of the first hole and the second hole, said mounting member is selectively positionable into one of said first hole and said second hole through the guiding section;

wherein when the mounting member passes through the first hole of the adjusting member, the adjusting member abuts against the first movable member of the damper;

wherein when the mounting member passes through the second hole of the adjusting member, the adjusting member does not abut against the first movable member of the damper.

2. The damping device of claim 1, wherein the housing has a longitudinal passage configured to accommodate the damper.

3. The damping device of claim 1, wherein the housing comprises an extension part, and the adjusting member is movably installed on the extension part.

4. The damping device of claim 3, wherein the adjusting member comprises a main body and a flexible part connected to the main body, and the main body of the adjusting member has a transverse guiding feature defined by the first hole, the second hole, and the guiding section for allowing the adjusting member to be transversely movable relative to housing.

5. The damping device of claim 1, wherein the first movable member of the damper is a cylinder and the second movable member of the damper is a piston rod.

6. A hinge comprising:

a first component;

a second component pivotally connected to the first component;

an elastic member configured to provide an elastic force when the second component is opened or closed relative to the first component;

a linkage member configured to move when the second component is rotated relative to the first component; and a damping device installed on one of the first component and the second component, the damping device comprising:

a housing;

a damper arranged on the housing, the damper comprising a first movable member and a second movable member longitudinally movable relative to each other;

an abutting member configured to abut against the second movable member of the damper for allowing the first movable member to be moved between a first predetermined position and a second predetermined position relative to the second movable member; and an adjusting member movable relative to the housing;

wherein the housing has a longitudinal passage configured to accommodate the damper, and an extension part, the adjusting member is movably installed on the extension part;

wherein the adjusting member comprises a main body and a flexible part connected to the main body, and the main body of the adjusting member has a transverse guiding feature for allowing the adjusting member to be transversely movable relative to the housing;

wherein, the transverse guiding feature comprises a first hole, a second hole, and at least one guiding section located between the first hole and the second hole, the hinge further comprises a mounting member connected to the extension part of the housing and passing through one of the first hole and the second hole, said mounting member is selectively positionable into one of said first hole and said second hole through the guiding section;

wherein when the mounting member passes through the first hole of the adjusting member, the adjusting member abuts against the first movable member of the damper, such that the first movable member is located at the first predetermined position;

wherein when the mounting member passes through the second hole of the adjusting member, the adjusting member does not abut against the first movable member of the damper, such that the first movable member is located at the second predetermined position, and when the second component is moved to switch from an open state to a close state relative to the first component, the linkage member pushes the first movable member of the damper from the second predetermined position to the first predetermined position for providing damping effect.

7. A hinge comprising:

a first component;

a second component pivotally connected to the first component;

an elastic member configured to provide an elastic force when the second component is opened or closed relative to the first component;

a linkage member configured to move when the second component is rotated relative to the first component;

a damping device installed on one of the first component and the second component, the damping device comprising:

a housing;

a damper arranged on the housing, the damper comprising a first movable member and a second movable member longitudinally movable relative to each other, the first movable member comprising an abutting part;

an abutting member configured to abut against the second movable member of the damper for allowing the first movable member to be moved between a first predetermined position and a second predetermined position relative to the second movable member; and an adjusting member movable relative to the housing, the adjusting member comprising a main body and a flexible part connected to the main body, wherein the main body has a transverse guiding feature for allowing the adjusting member to be transversely movable relative to the housing, the transverse guiding feature comprises a first hole, a second hole, and at least one guiding section located between the first hole and the second hole; and a mounting member connected to the housing and passing through one of the first hole and the second hole of the adjusting member said mounting member is selectively positionable into one of said first hole and said second hole through the guiding section;

wherein when the first movable member of the damper is located at the second predetermined position relative to the second movable member and the mounting member passes through the first hole of the adjusting member, the flexible part of the adjusting member abuts against the first movable member of the damper;

wherein when the second component is moved to switch from an open state to a close state relative to the first component, the linkage member pushes the first movable member of the damper from the second predetermined position to the first predetermined position for allowing the flexible part of the adjusting member to abut against the abutting part, in order to hold the first movable member at the first predetermined position relative to the second movable member.

* * * * *